US005272896A

United States Patent [19]

Mine

[11] Patent Number: 5,272,896

[45] Date of Patent: Dec. 28, 1993

[54] FORGING METHOD AND SYSTEM

[75] Inventor: Koichi Mine, Kanagawa, Japan

[73] Assignee: Nissan Motor Co., Ltd., Yokohama, Japan

[21] Appl. No.: 913,373

[22] Filed: Jul. 15, 1992

[30] Foreign Application Priority Data

Jul. 17, 1991 [JP] Japan ..... 3-176320

[51] Int. Cl.[5] ..... B21J 1/06; B21J 17/00

[52] U.S. Cl. ..... 72/24; 72/1; 72/4; 72/27; 72/342.1; 72/338; 72/361; 72/424; 83/23; 83/75; 83/107; 29/33 P; 29/34 R

[58] Field of Search ..... 72/339, 338, 419, 424, 72/420, 361, 342.1, 1, 3, 4, 24, 27; 83/23, 75, 107, 404, 358; 29/33 P, 34 R

[56] References Cited

U.S. PATENT DOCUMENTS

| | | | |
|---|---|---|---|
| 610,749 | 9/1898 | Treat | 72/424 |
| 2,971,414 | 2/1961 | Owen | 83/75 |
| 3,693,486 | 9/1972 | Maniaci | 83/107 |
| 4,309,600 | 1/1982 | Perry | 29/33 P |
| 4,641,515 | 2/1987 | Braun | 72/405 |

OTHER PUBLICATIONS

*The 12th International Forging Congress Report*, "Forging", by All Japan Forging Industrial Association, Jul. 31, 1962.

*Primary Examiner*—Daniel C. Crane

*Attorney, Agent, or Firm*—Foley & Lardner

[57] ABSTRACT

A forging method for making a forged product from an elongate steel bar material. The forging comprises a heating step in which the elongate bar material is heated, a cutting step in which the heated bar material is cut into billet materials each having a predetermined length, and a forging step in which the billet materials are successively forged. In this forging method, when an abnormality arises in the forging step, the cutting in the cutting step is interrupted and the bar material in the heating step is maintained in the heating step without being transferred toward the cutting step. Additionally, unless the abnormality is normalized within a predetermined limit time, the cutting in the cutting step is restarted and the billet materials formed after the restarting of the cutting are transferred to a storing apparatus which is outside of a normal forging line.

20 Claims, 13 Drawing Sheets

FORGING METHOD AND SYSTEM

BACKGROUND OF THE INVENTION

1. Field of the Invention

This invention relates generally to improvements in a forging method and system accomplishing warm or hot forging, and more particularly to such a forging method and system of a so-called inline cutting type wherein a cutting operation for a heated elongate bar material is made immediately before forging in a forging line.

2. Description of the Prior Art

A forging system of the above-mentioned type has been proposed and put into practical use as disclosed, for example, in "The 12th International Forging Congress Report", page 205, titled "Forging" and published on Jul. 31, 1962 by All Japan Forging Industrial Association. In this forging system, elongate bar materials stocked in a stock area or a return area are fed to an induction heating apparatus to be heated. The thus heated bar material is moved out from the heating apparatus bit by bit to be fed to a billet shear adjacent the heating apparatus. The billet shear cuts the bar material into billet materials having a predetermined length. The thus formed billet materials are fed to a forging press to be subjected to a die-forging.

The return area is provided to stock therein the bar materials which have been once heated by the induction heating apparatus and returned without being cut by the billet shear. For example, in case a trouble arises in the forging press on the downstream side in a forging line, the cutting operation of the billet shear is immediately interrupted, and all the bar materials (including one in the course of cutting) within the induction heating apparatus are returned to the return area. Within the induction heating apparatus, a plurality of the bar materials are usually aligned in a line. The bar materials returned to the return area are allowed to stand to be cooled to ordinary temperature and then reused together with the bar materials in the stock area.

However, drawbacks have been encountered in such a conventional forging system, as discussed below. Since the forging system is such arranged that all the bar materials (including one in the course of cutting) within the induction heating apparatus are returned to the return area immediately upon occurrence of the trouble on the downstream side of the induction heating apparatus, a variety of bar materials different in length are unavoidably mixed and present in the return area after several troubles have continuously occurred. Accordingly, for example, in case of suspending the bar materials in the return area and transferring them to a required place by using an overhead travelling crane and wires, a wire-binding or wire-applying operation for the bar materials of different length is very difficult, thereby making it difficult to handle the bar materials as a bundle with the overhead travelling crane.

The above-discussed transferring operation for the bar materials is carried out, for example, when the return area has been filled with the bar materials or when an initial setup of the forging process is changed. Particularly at the initial setup changing, it is required to once transfer all the bar materials in the return area to a separate area in order to feed new bar materials thereby preventing foreign materials from being mixed with the new bar materials. Thus, such a transferring operation is necessarily carried out at the initial setup changing.

Otherwise, it has been proposed to carry out a standby operation of the induction heating apparatus, as another measure in case of trouble arising in the downstream side step or apparatus. In this standby operation, the bar materials are maintained within the induction heating apparatus in such a manner that the bar materials make their reciprocating movement in the feed direction of the bar materials so that the bar materials are kept within a predetermined temperature range. Thus, in the standby operation, the materials within the induction heating apparatus are returned to the return area immediately when any trouble arises in the downstream side step or apparatus.

However, with this type of standby operation, the standby operation of the induction heating apparatus is continued as long as the trouble in the downstream side step or apparatus is solved or restored. Additionally, each of the bar materials B within the induction heating apparatus makes its reciprocating movement within a particular heater region of the induction heating apparatus, dissimilarly to its movement during a normal operation, and therefore a temperature difference becomes large throughout the length of each bar material so that excessive heat is applied to a particular part of the bar material. As a result, the structure of part of the bar material is unavoidably changed or deteriorated, thereby making it impossible to use the bar material as a forging material.

For example, in the case of a hot forging, an allowable limit time for the standby operation is within 5 minutes on the assumption that the optimum heating temperature for the bar materials within the induction heating apparatus is 1230° C.±25° C. Similarly, the allowable limit time is within 20 minutes on the assumption that the optimum heating temperature is 1230° C.±35° C. Accordingly, if the standby operation is continued over the above allowable limit time, the bar materials heated at a temperature outside the optimum heating temperature are unavoidably fed to the dies of the forging press.

SUMMARY OF THE INVENTION

It is an object of the present invention to provide an improved forging method and system which can overcome the drawbacks encountered in conventional similar forging methods and systems.

Another object of the present invention is to provide an improved forging method and system by which a transferring operation of bar materials from a return area is facilitated, prolonging the life of forging dies of a forging press.

A further object of the present invention is to provide an improved forging method and system which can prevent a bar material (different in length from normal ones and in the course of cutting) from being returned to a return area or the like on the upstream side of a heating step or apparatus in case any trouble arises in a forging step or apparatus.

A still further object of the present invention is to provide an improved forging method and system which can prevent formation of billet materials which have been heated at a temperature outside an optimum temperature range.

An aspect of the present invention resides in a forging method which comprises the following steps: (1) An elongate bar material is heated; (2) The heated bar material is cut into billet materials each having a predetermined length; (3) The billet materials successively transferred from the cutting step are forged; (4) The cutting is interrupted and the bar material in the heating step is maintained in the heating step without being transferred toward the cutting step, when an abnormality arises in a step on a downstream side of the cutting step in a normal forging line; and (5) The cutting is reopened and the billet materials formed after the reopening of the cutting are transferred to a storing apparatus outside the normal forging line, unless the abnormality is normalized within a predetermined limit time.

Another aspect of the present invention resides ill a forging system which comprises an apparatus for heating an elongate bar material, an apparatus for cutting the heated bar material into billet materials each having a predetermined length, and an apparatus for forging the billet materials which are successively transferred from the cutting apparatus.

The forging system further comprises an apparatus for interrupting a cutting operation of the cutting apparatus and maintaining the bar material in the heating apparatus without feeding the bar material to the cutting apparatus, when an abnormality arises on a downstream side of the cutting apparatus in a normal forging line; and for reopening the cutting operation of the cutting apparatus and feeding the billet materials formed after the reopening of the cutting operation of the cutting apparatus to a storing apparatus, unless the abnormality is normalized within a predetermined limit time. The storing apparatus is for storing the billet materials from the cutting apparatus and is located outside the normal forging line.

Accordingly, in case any trouble or abnormality arises, for example, in the forging step or apparatus and the abnormality is detected, the cutting operation of the cutting step or apparatus is interrupted concurrently with starting a standby operation in which the bar materials are maintained within the heating step or apparatus without being transferred to the cutting step or apparatus. Then, a standby operation time for the bar materials is watched. If standby time exceeds a predetermined limit time without normalization of the abnormality within the predetermined limit time, the cutting operation of the cutting step or apparatus is reopened and the billet materials formed after the reopening of the cutting operation are transferred to the separate storing step or apparatus.

Thus, the bar material is cut into the billet materials before it is excessively heated due to the prolonged standby operation, thereby preventing formation of billet materials deteriorate due to an overheating so that all the billet materials are reusable. This the yield for the materials while facilitating the handling of the billet materials from the storage step or apparatus by using a forklift or the like.

Additionally, by virtue of preventing formation of the deteriorated billet materials, such deteriorated billet materials cannot be fed to the normal forging line, thereby further improving the yield for the materials while improving the quality of resultant forged products and prolonging the life of dies of a forging press.

Furthermore, in case a long time is required to completely normalize the abnormality, the bar materials within the heating step or apparatus are preferably returned to, for example, a return area located on the upstream side of the heating apparatus, continuing the cutting operation of the cutting step or apparatus for the bar material in the course of cutting. Consequently, the bar material having a different length is prevented from mixing with the normal bar materials in the return area, thereby facilitating handling of the returned bar materials in the return area.

DETAILED DESCRIPTION OF THE INVENTION

Figure 1:
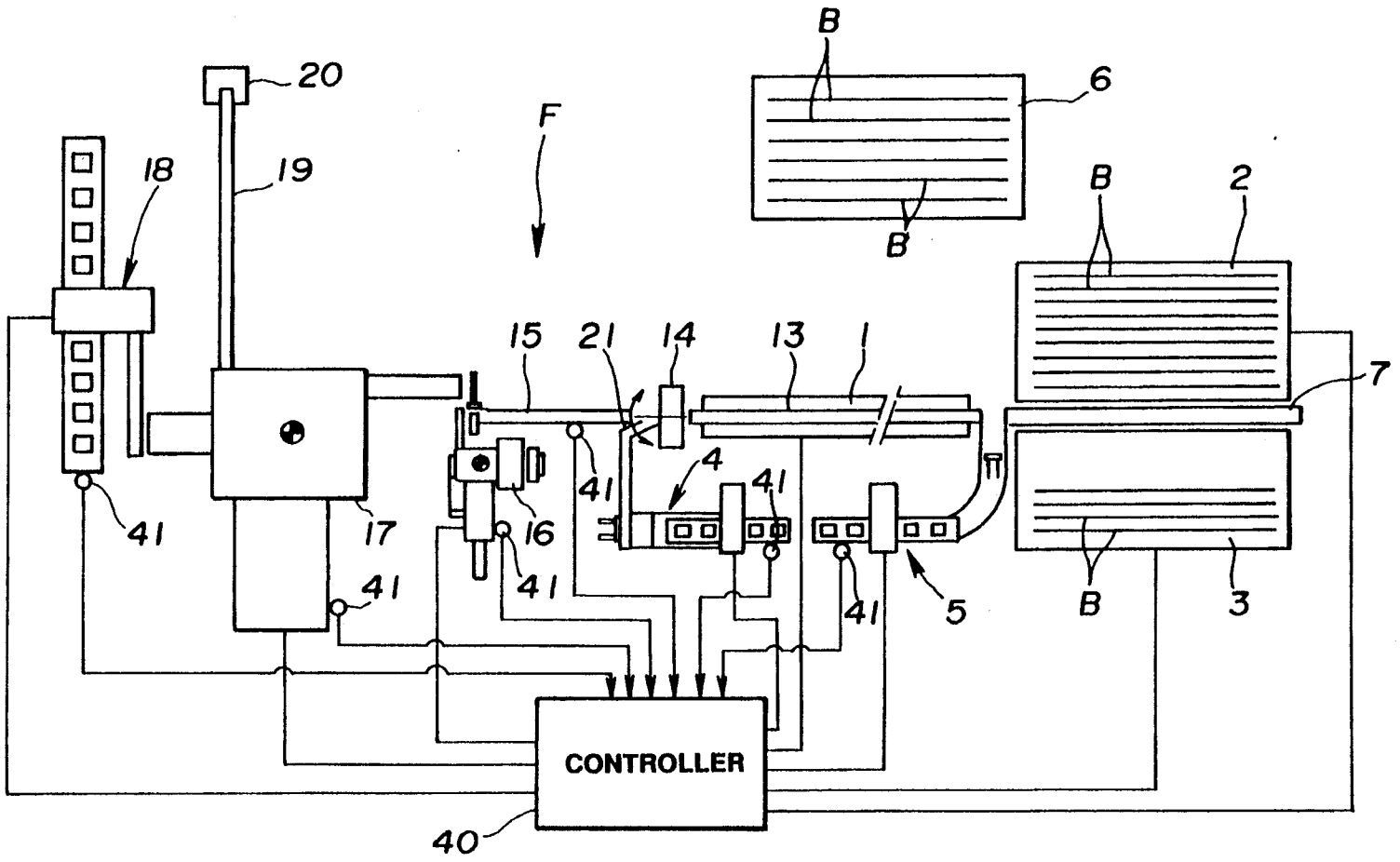
FIG. 1 is a plan view of an embodiment of a forging system in accordance with the present invention.

Referring now to FIG. 1, a preferred embodiment of a forging system according to the present invention is illustrated by the reference character F. The forging system F is comprised of an induction hearing apparatus 1 for heating steel bar materials B which are stored in a stock area 2 and a return area or returned material arranging apparatus 3. Additionally, a billet material arranging or storing apparatus 4 and a billet material feed apparatus 5 are provided in parallel with the induction heating apparatus 1.

Prismatic steel bar materials B having a length of about 6 m stocked in a steel yard 6 are hung up by an overhead travelling crane (not shown) upon being bundled and carried onto the stock area 2. In the stock area 2, the bar materials B are separated from each other and arranged side by side to be located parallel with each other. The thus arranged bar materials B will be introduced into the induction heating apparatus 1 one by one.

Figure 5:
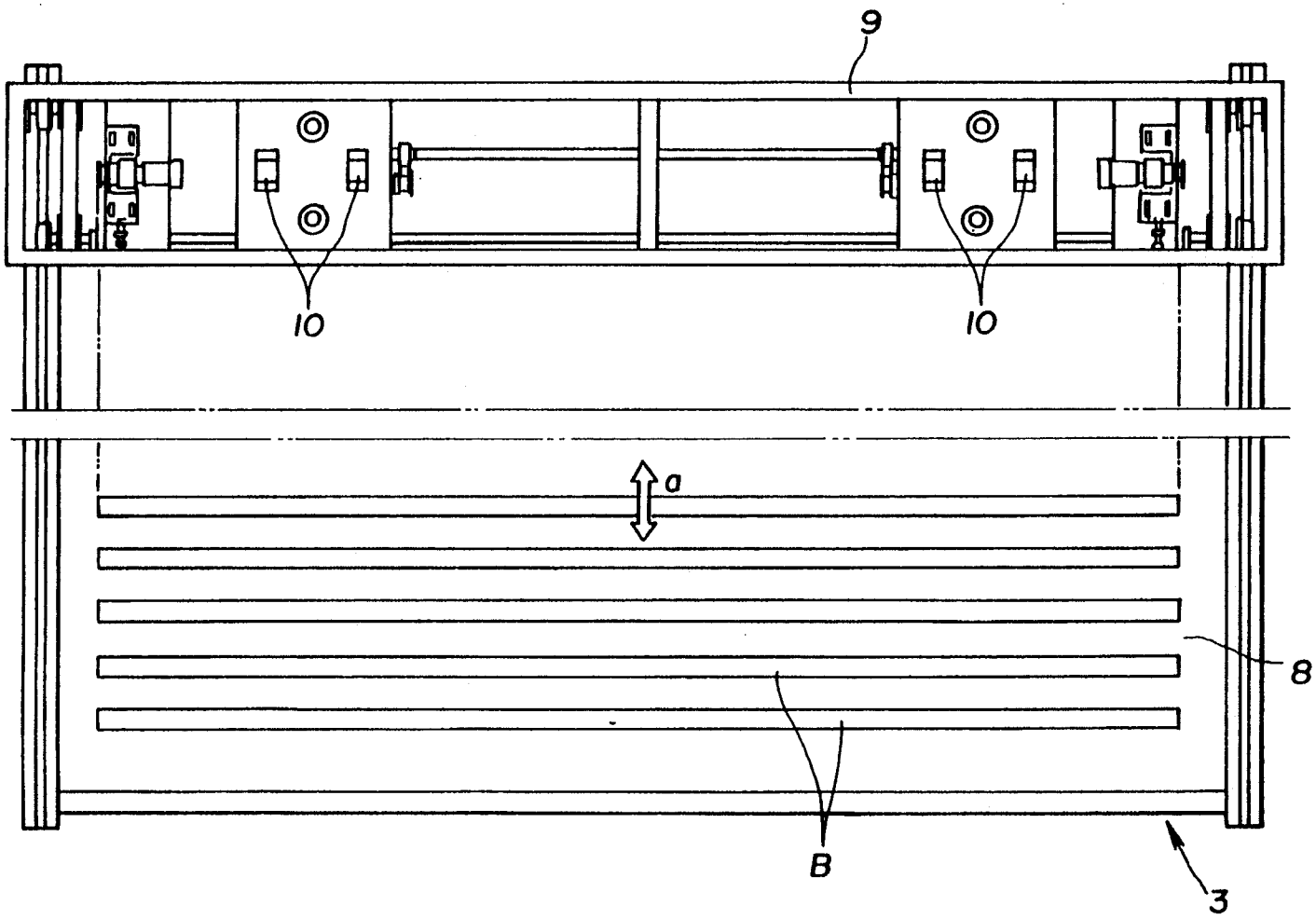
FIG. 5 is a plan view of a returned bar material arranging apparatus in the forging system of FIG. 1.
Figure 6:
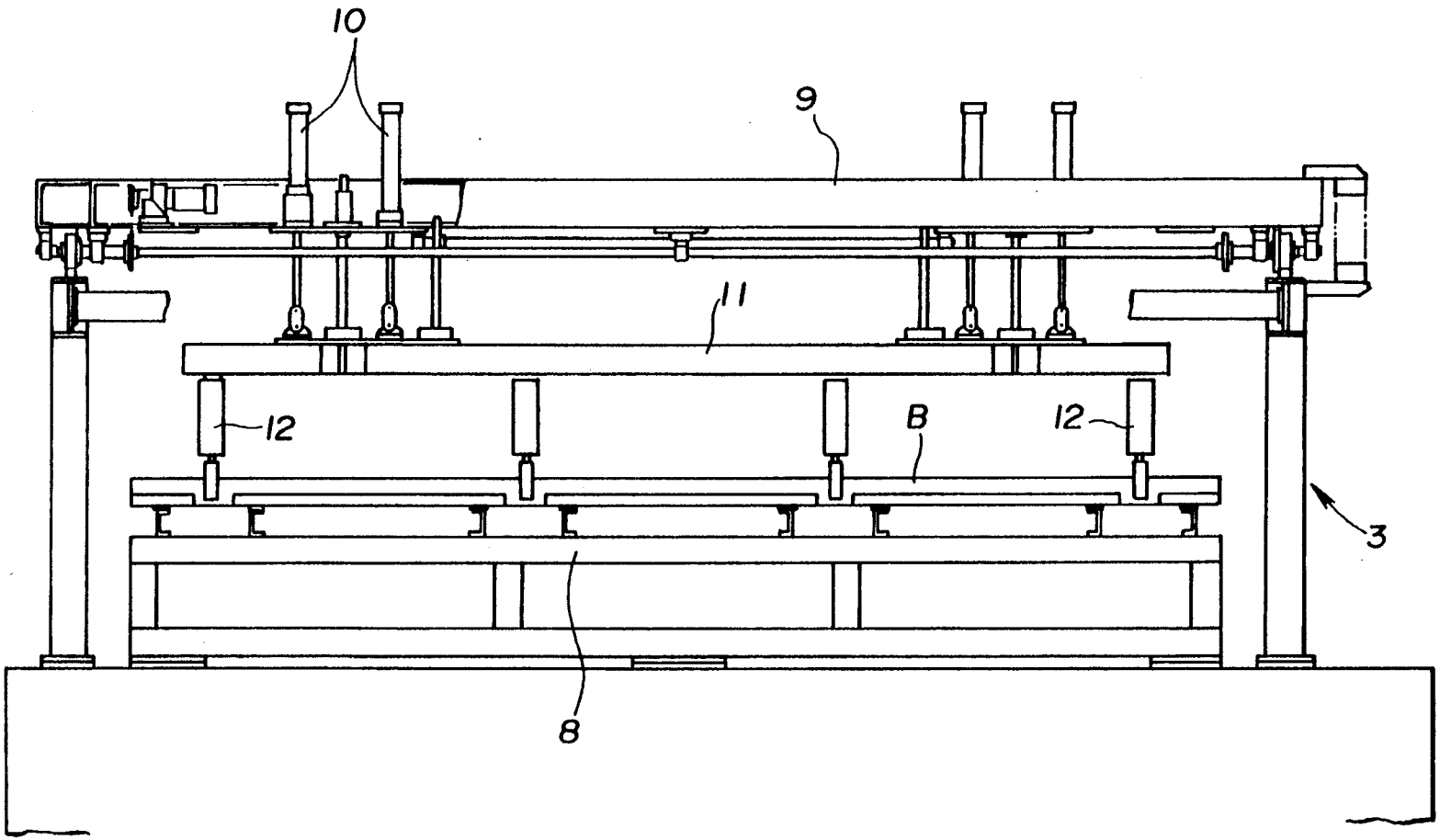
FIG. 6 is a front view of the returned bar material arranging apparatus of FIG. 5.
Figure 7:
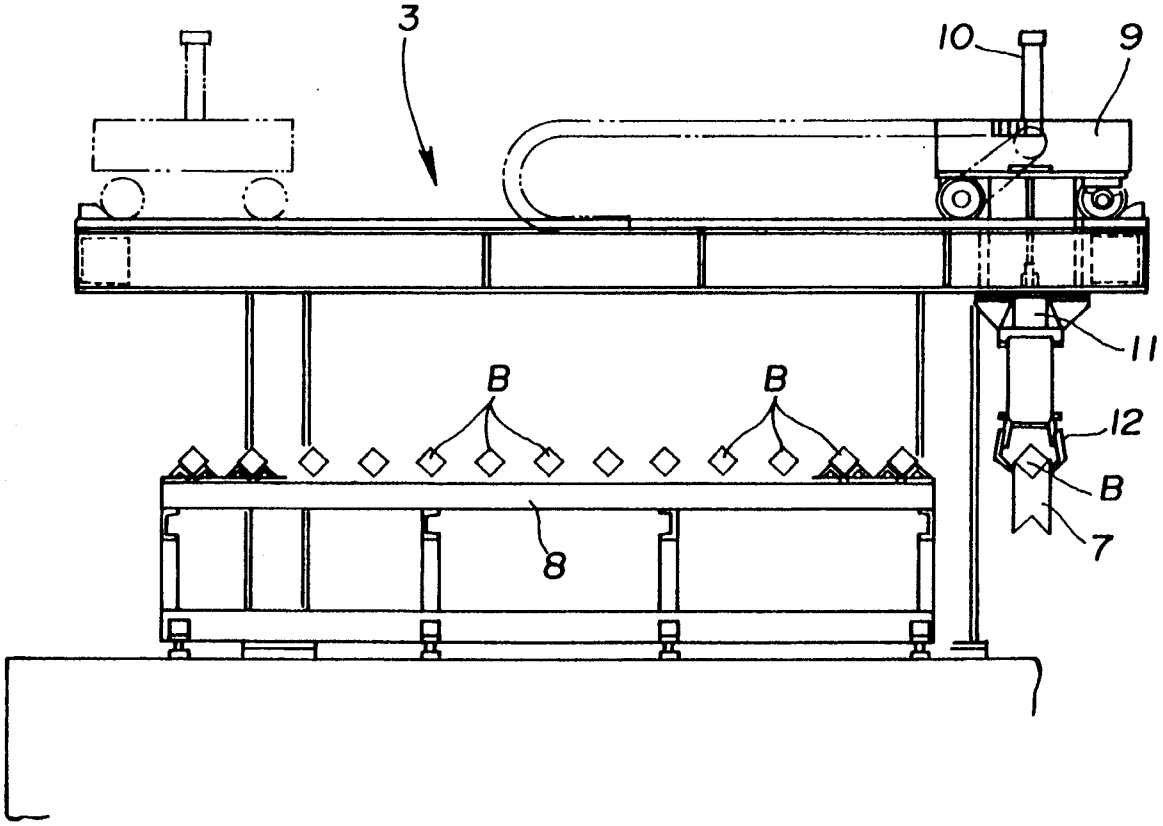
FIG. 7 is a right-side view of the returned bar material arranging apparatus of FIG. 5.

The returned material arranging apparatus 3 is constructed and designed to arrange and store therein the bar materials (returned steel bar materials) B which have been heated once in the induction heating apparatus 1 and returned from the apparatus 1. As shown in FIGS. 5 to 7, the returned material arranging apparatus 3 includes a bar material mount table S. A carriage 9 is mounted on the mount table 8 and movable in directions of a two-headed arrow a. The carriage 9 is provided with a carrying head 11 which is vertically movable under the action of shiftcylinders (hydraulic cylinders) 10. The carrying head 11 is provided with grippers 12 for gripping each bar material B. The location and kind of all the bar materials B on the mount table 8 are under a centralized control according to a bar material control table stored in a controller 40 which will be discussed in detail after. In case there arises a command for supplying the bar materials B from the returned material arranging apparatus 3 into the induction heating apparatus 1, the carrying head 11 grips the designated bar material B on the mount table 8 and put it onto a feed apparatus 7 through which the bar material B is introduced into the induction heating apparatus 1. The carrying head 11 also functions to rearrange the bar materials B on the mount table 8 so as to chance the locations of the bar materials B.

Figure 8:
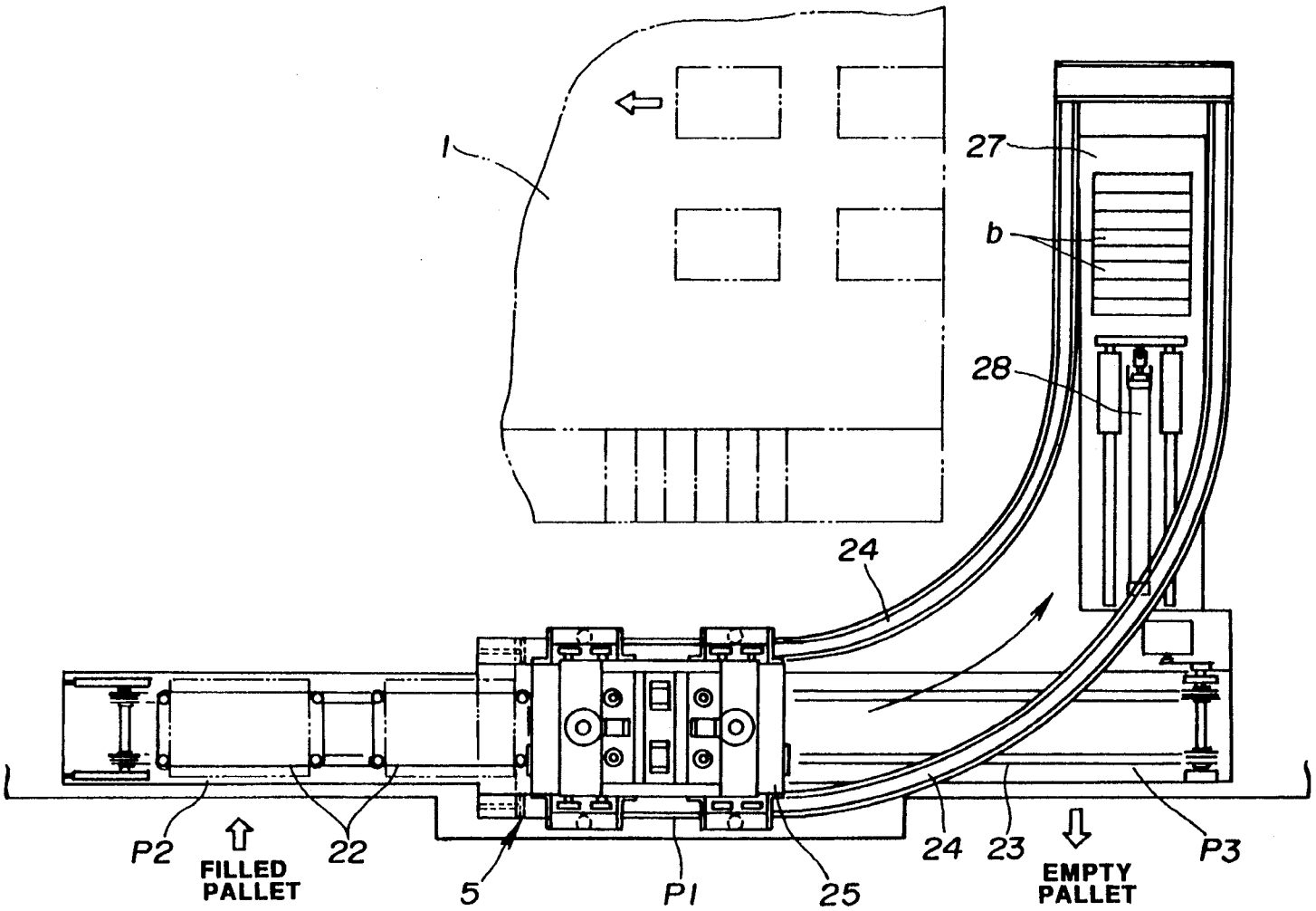
FIG. 8 is a plan view of a billet material feed apparatus in the forging system of FIG. 1.
Figure 9:
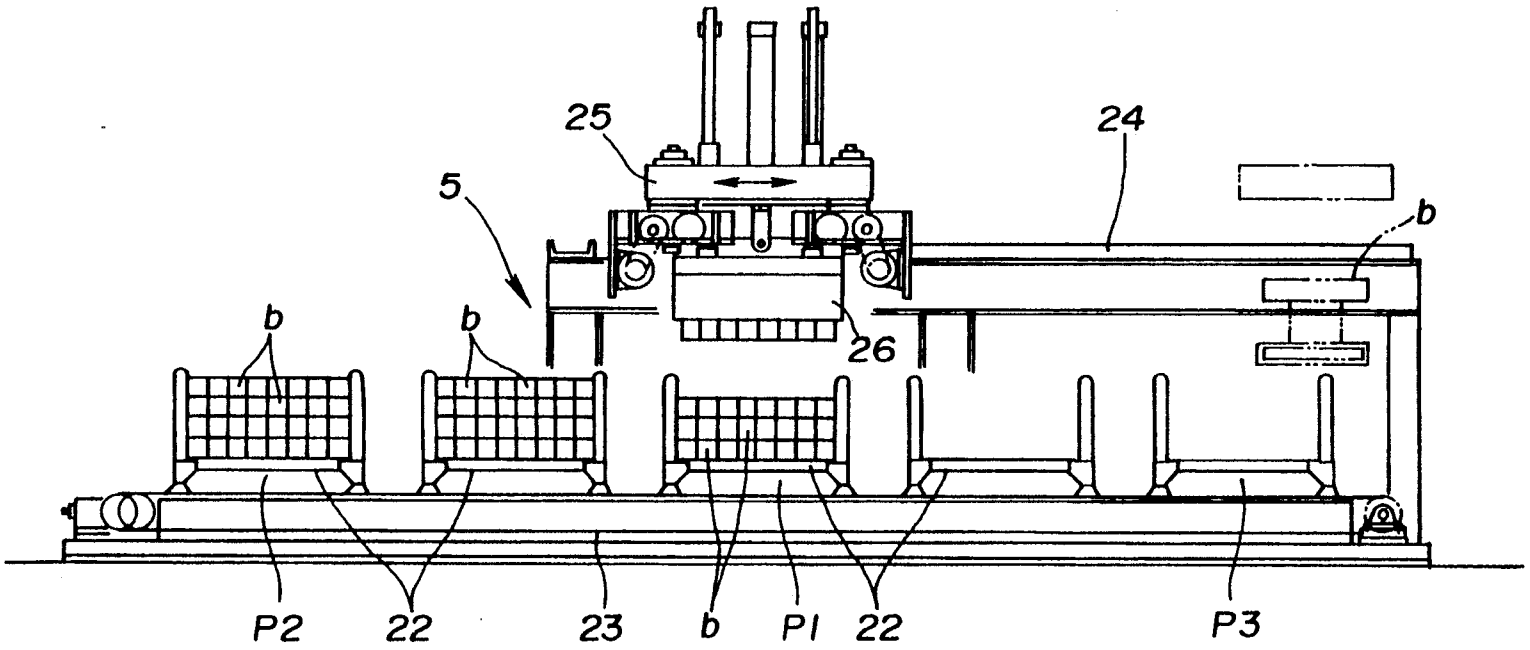
FIG. 9 is a front view of the billet material feed apparatus of FIG. 8.
Figure 10:
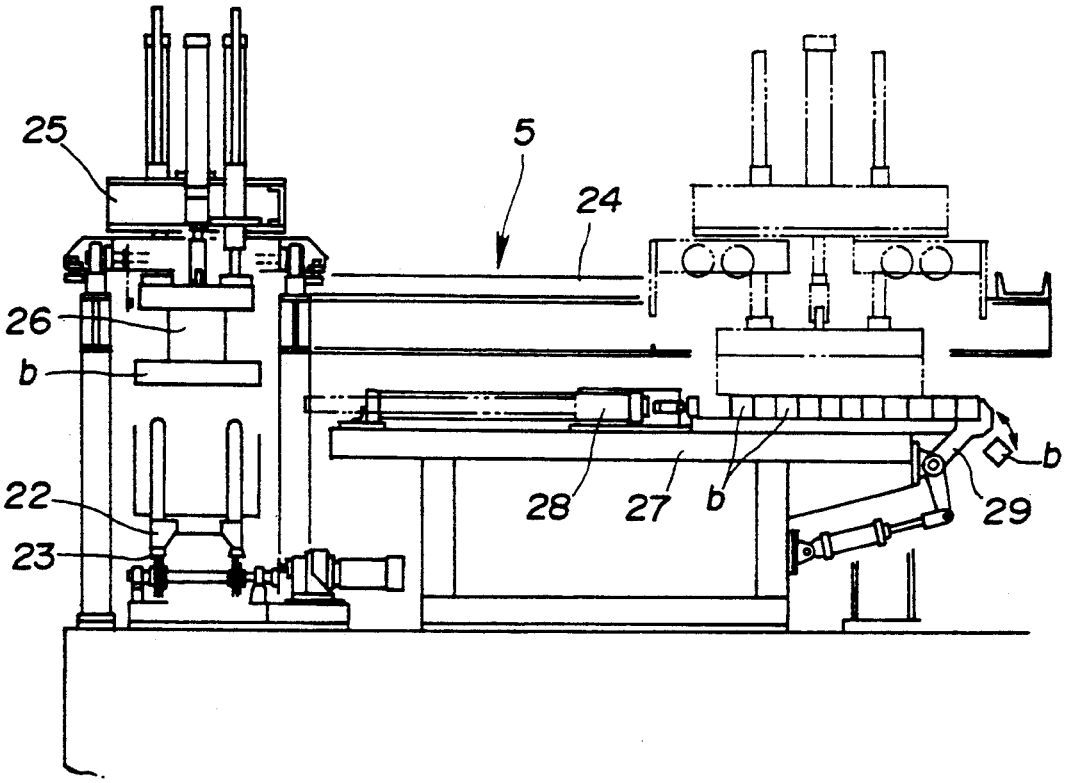
FIG. 10 is a right-side view of the billet material feed apparatus of FIG. 8.

The induction heating apparatus 1 has formed thereinside a plurality of heating zones (not shown) which are aligned and continuous with each other in a longitudinal direction thereof. In each heating zone, a plurality of heaters (not shown) are provided so that a plurality of the bar materials B aligned in a line can be simultaneously subjected to a heat treatment. The bar materials B introduced into the induction heating apparatus 1 are heated, for example, to a temperature of 1230° C.±25° C. and then sent to a billet shear 14 through a bar material carrying apparatus 13 as shown in FIG. 1. The carrying apparatus 13 is arranged to carry the bar materials B under the action of feed rollers (not shown). The billet shear 14 is a cutting apparatus and cuts the long bar material B into short billet materials b as shown in FIGS. 8, 9 and 10.

The thus formed billet materials b are successively transferred through a transferring apparatus 15 to a reduce roll 16 to be subjected to a roll fabrication, by which the billet material b is roughly formed into a desired shape. The billet materials b are then supplied to a forging press 17 under the action of a three-dimensionally operated transfer feeder (not shown), in which the roughly formed billet materials b are subjected to a die-forging. The operation of the forging press 17 includes, for example, four stages such as three (bending, rough and finishing) forging stages and a final trimming stage. At the final trimming stage, a product having a predetermined shape can be obtained for the first time, in which burrs are cut out and removed from the product. The resultant products are palletized by a palletizer 18, while the burrs removed from the products are recovered through a scrap conveyer 19 into a scrap box 20.

At least the feed apparatus 7, the induction heating apparatus 1 (the carrying apparatus 13), the billet shear 14, the transferring apparatus 15 and the forging press 17 constitute a normal forging line through which a normal forging or operation is achieved. In this regard, the billet material arranging apparatus 4 is not on the normal forging line, because the apparatus 4 is operated under a condition outside the normal operation.

The billet material supply apparatus 5 is arranged to depalletize the billet materials b palletized by the billet material arranging apparatus 4 and to introduce the billet materials b into the induction heating apparatus 1. Thus, the induction heating apparatus 1 may be supplied with the billet materials b from the billet material supply apparatus 5, instead of the bar materials B from the stock area 2 or from the returned material arranging apparatus 3.

The billet material arranging apparatus 4 functions to store therein the billet materials b which have been cut by the billet shear 14 and not supplied to the side of the reduce roll 16, and palletize the stored billet materials b in a predetermined pallet. Here, a turnable chute 21 is provided at the outlet side of the billet shear 14 to select the direction of supply of the billet materials b from the billet shear 14 into the side of the reduce roll 16 or into the side of the billet material arranging apparatus 4.

As shown in FIGS. 8 to 10, the billet material feed apparatus 5 includes a pallet conveyer 23 on which a plurality of pallets 22 are mounted thereon. A carriage 25 is provided to be runnable on and along rails 24 disposed over the pallet conveyer 23. The rails 24 are curved so that the opposite end sections thereof are directed to be generally perpendicular to each other. The carriage 25 is provided with a magnetic chuck 26 which is vertically movable. A billet supply table 27 is disposed near the entrance of the induction heating apparatus 1 and located under the rails 24. A pusher 28 is mounted on the table 27 to push the billet materials b in the direction of the ends of the rails 24. Additionally, a swing arm 29 is swingably installed to the table 27 to support the front-most one of the plural billet materials b arranged contactingly side by side. Upon downward swing of the swing arm 29, the front-most billet material b drops downward to be received by the feed apparatus 7.

In this embodiment, as shown in FIGS. 8 and 9, the billet materials b are taken out from the pallet 22 at a position P1. The billet materials b are ones palletized by the billet material arranging apparatus 4 or ones formed by cutting the bar material B with a separate billet shear (not shown). The billet materials b in a state palletized in the pallet 22 are carried on a pallet conveyer 23 at a position P2 in FIGS. 8 and 9 by means of a forklift (not shown) or the like. The thus carried billet materials b are moved together with the pallet 22 to the position P1 by means of the pallet conveyer 23. At the position P1, the magnetic chuck 26 attracts and supports a group of the billet materials b in a row within the pallet 22. The thus attracted and supported billet materials b are carried with the movement of the carriage 25 to a position above the billet material supply table 27 and put on the table 27. The billet materials b on the billet material supply table 27 are located between the pusher 28 and the swing arm 29. Here, the pusher 28 pushes the billet material b one by one in timed relation to the swinging action of the swing arm 29, so that the billet material b falls down upon the downward swing of the swing arm 29. Then, the billet materials b on the billet material supply table 27 are successively carried through the feed apparatus 7 into the induction heating apparatus 1.

The pallet 22 which has been brought into an empty state at the position P1 is moved in timed relation to the movement of the pallet 22 in a filled state to a position P3 at which the empty pallet 22 is carried out by means of the forklift or the like.

Figure 11:
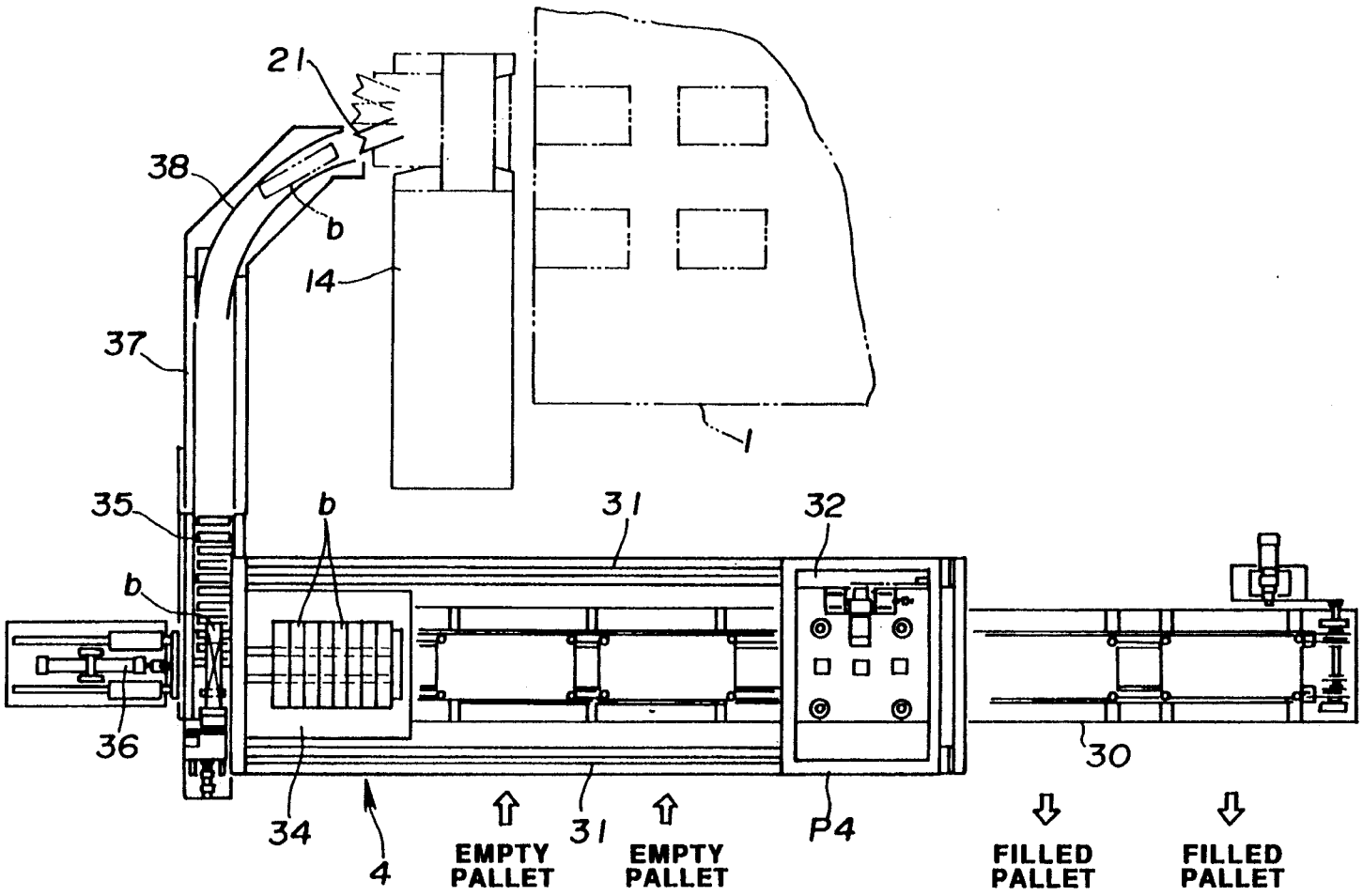
FIG. 11 is a plan view of a billet material arranging apparatus in the forging apparatus of FIG. 1.
Figure 12:
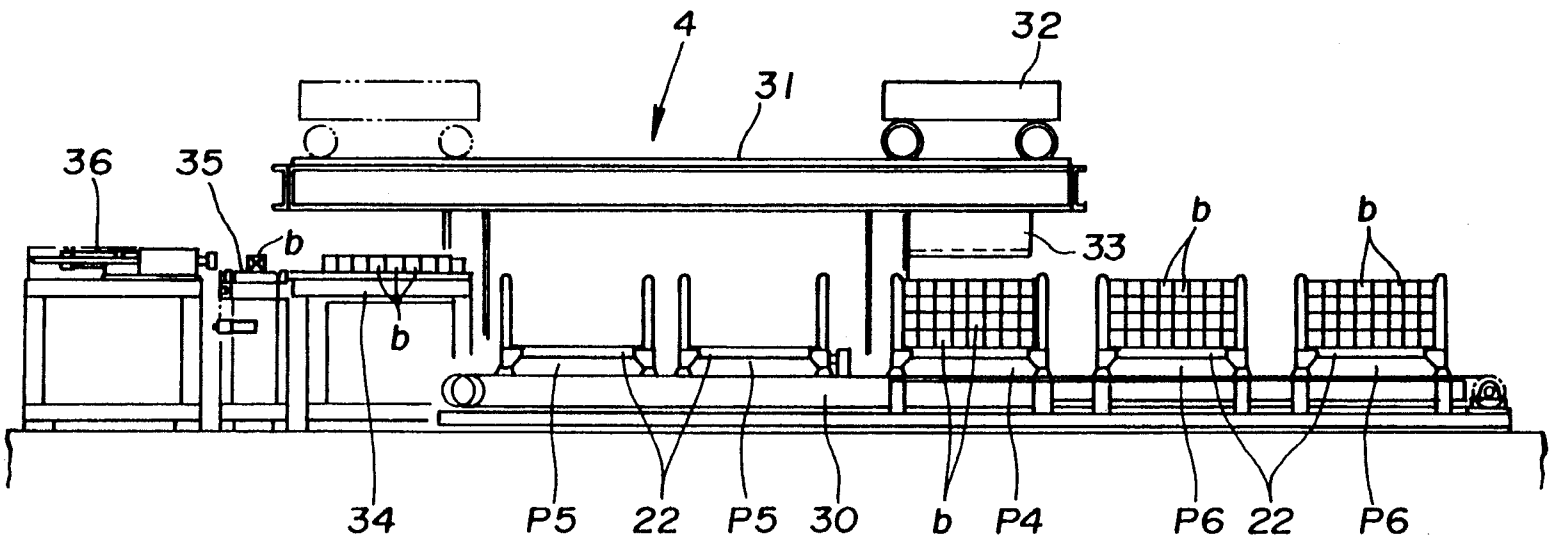
FIG. 12 is a front view of the billet material arranging apparatus of FIG. 11.
Figure 13:
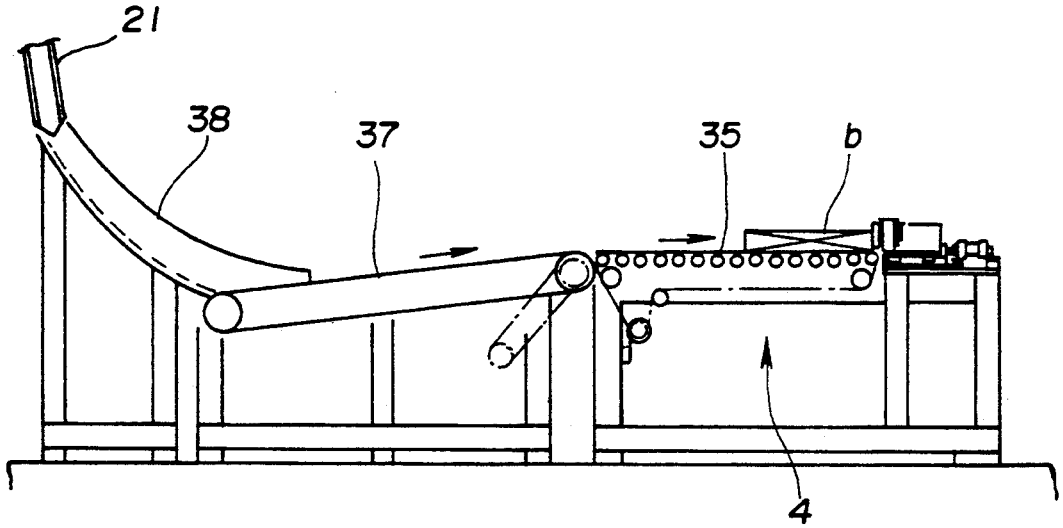
FIG. 13 is a right-side view of the billet material arranging apparatus of FIG. 11.
Figure 14:
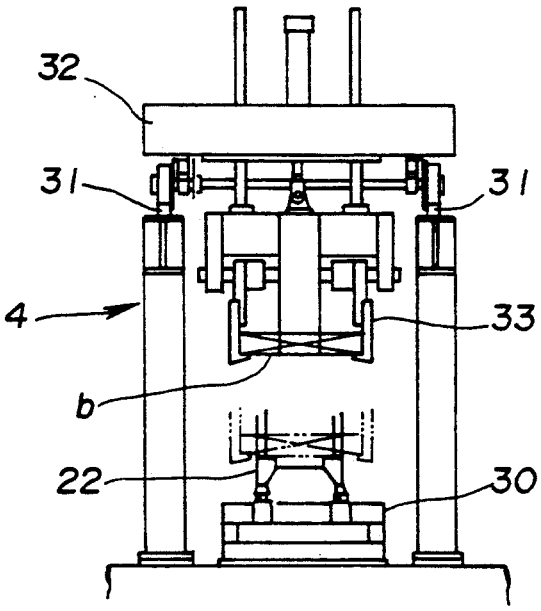
FIG. 14 is a left-side view of the billet material arranging apparatus of FIG. 11.

As shown in FIGS. 11 to 14, the billet material arranging apparatus 4 includes a pallet conveyer 30 oil which a plurality of the pallets 22 are mounted. A carriage 32 is disposed movable on and alone, rails 31 located over the pallet conveyer 30. The carriage 32 is provided with a carrying head 33 which is vertically movable. A billet material arranging table 34 is disposed under the rails 31 and located close to the front end of the pallet conveyer 30. Additionally, disposed on the upstream side of the billet material arranging table 34 are a roller conveyer 35, a pusher 36, a belt conveyer 37 and an auxiliary chute 38. Accordingly, the billet materials b from the billet shear 14 are carried through the chute 21, the auxiliary chute 38 and the belt conveyer 37 onto the roller conveyer 35. The billet materials b on the roller conveyer 35 are successively carried onto the billet material arranging table 34 by means of a pusher 36 and then arranged in a row and in a manner to be contacted side by side as shown in FIG. 11. When a predetermined number or group of the billet materials b have been prepared in a row on the billet material arranging table 34, the carrying head 33 grips or holds the billet materials all together on the table 34. The thus gripped billet materials b are carried with the movement of the carriage 32 to a position P4. At the position P4, the billet materials b are loaded on the pallet 22. Further groups of the predetermined number of the billet materials b arranged on the table 34 are successively loaded on the pallet 22 one upon another. Each pallet 22 in the empty state is carried to a position P5 by means of the forklift or the like, while each pallet 22 in the empty state is carried from a position P6 similarly by means of the forklift or the like.

The manner of operation of the above forging system F will be discussed hereinafter mainly with reference to FIGS. 2 to 4 in addition to FIG. 1.

A variety of the apparatuses constituting the forging system F are under the centralized control of the controller 40 including a CPU (central processing unit) 39. Additionally, the apparatuses are respectively equipped with a variety of sensors 41 each of which detects an abnormality or failure of the corresponding apparatus. As shown in FIG. 2, the respective sensors 41 are adapted to generate a reduce roll abnormality signal 16*a*, a forging press abnormality signal 17*a*, a palletizer abnormality signal 18*a*, a billet material arranging apparatus abnormality signal 4*a*, a billet material feed apparatus abnormality signal 5*a* and a transferring apparatus abnormality signal 15*a* when the abnormalities or failures occur respectively in the reduce roll 16, the forging press 17, the palletizer 18, the billet material arranging apparatus 4, the billet material feed apparatus 5 and the transferring apparatus 15. Each of the abnormality signals is input through an input section to the CPU 39. The CPU 39 is adapted to output a variety of operation commands through an output section, in response to the abnormality signals. The operation commands include a normal operation command for commanding the normal operation, a standby operation command for commanding a standby operation, a low-speed feed and cut operation command for commanding a low-speed feed and cut operation, and a return operation command for commanding a return operation as shown in FIG. 2.

For example, during the normal operation, either one of a bar material heating and cutting operation mode, a returned material heating and cutting operation mode, and a billet material heating operation mode is selected. In the bar material heating and cutting operation mode or the return material heating and cutting mode, the bar materials B in the stock area 2 or in the returned material arranging apparatus 3 are introduced into the induction heating apparatus 1 while the bar materials B heated by the induction heating apparatus 1 are successively cut by the billet shear 14 thereby to provide the billet materials b. The billet materials b from the billet shear 14 are all supplied to the side of the reduce roll 16 without being supplied to the billet material arranging apparatus 4, so that the billet materials b are successively subjected to a roll fabrication by the reduce roll 16 and finally subjected to a die-forging by the forging press 17. In the billet material heating operation mode, the billet materials b are supplied from the billet material supply apparatus 5 into the induction heating apparatus 1, in which the billet materials b heated by the induction heating apparatus 1 are supplied through the billet shear 14 to the reduce roll 16.

It will be understood that a production line during the normal operation corresponds to the normal forging line.

During the operation of the forging system F in the bar material heating and cutting mode or in the returned material heating and cutting mode, when any trouble arises in the forging press 17 (for example, the transfer feeder of the forging press 17 falls to hold and drops the billet material b during carrying the billet material b), a mis-grip sensor (not shown) attached to the transfer feeder is switched ON. In response to this, the controller 40 outputs a command for interrupting the cutting operation to the billet shear 14 simultaneously with outputting a command for changing the directional location of the chute 21. At this time, the controller 40 provides the standby operation command to the induction heating apparatus 1. It will be understood that the directional location changing command of the chute 21 causes the chute 21 to be directed toward the side of the billet material arranging apparatus 4 as shown in FIG. 1.

The operation of the forging system F after output of the standby operation command will be explained with reference to a flowchart of FIG. 3.

When the standby operation command is output from the controller 40 as shown in a step S1 (output standby operation command), a judgement is made as to whether the length of the remaining part (not yet cut) of the bar material B in the course of cutting operation by the billet shear 14 is not smaller than, for example, 4 m or not as shown in a step S2 (Is length of remaining part of the bar material in the course of cutting not smaller than 4 m ?). In case of smaller than 4 m, the cutting operation of the remaining part of the bar material B by the billet shear 14 is continued as shown in step S3 (Continue cutting operation upon directing chute toward billet material arranging apparatus). Then, the cutting operation of the billet shear 14 is interrupted at the time at which the cutting of the bar material B in the course of cutting operation has been completed. In this case, the chute 21 on the outlet side of the billet shear 14 has been already changed in directional location or directed toward the side of the billet material arranging apparatus 4, so that all the billet materials b are supplied to the side of the billet material arranging apparatus 4 without being supplied to the side of the reduce roll 16.

In case the length of the remaining part (not yet cut) of the bar material B in the course of cutting operation by the billet shear 14 is not smaller than 4 m, the standby operation is initiated as shown in a step S4 (Initiate standby operation). As will be seen, when the cutting operation by the billet shear 14 is completed, the standby operation is initiated. However, in case an abnormality or failure occurs in the induction heating apparatus 1 itself, the cutting operation by the billet shear 14 is immediately interrupted regardless of the length of the remaining part of the bar material B in the course of the cutting operation by the billet shear 14.

During the standby operation, the bar material B is held within the induction heating apparatus 1 without being carried out to the side of the billet shear 14, so that a standby is made waiting the restoration or normalization of the troubled condition (abnormality), maintaining the bar material B at a temperature within a predetermined range in order that the bar material B will be able to be immediately subjected to the forging. In this standby operation, the bar material B makes its reciprocating movement in a longitudinal direction within the induction heating apparatus 1 thereby to accomplish a uniform heating of the bar material B while maintaining a lower voltage supplied to the heater coils of the induction heating apparatus 1.

Here, if the standby operation continues for a long time, a temperature difference throughout the length of the bar material B gradually increases. Assuming that the temperature of the bar material B suitable for the forging within a range of 1230° C.±25° C., an allowable limit time for the standby operation will be within 2 to 5 minutes. In this regard, if the allowable limit time for the standby operation is preset at 5 minutes, an actual time of the standby operation is measured to judge as to whether the standby operation time is not shorter than 5 minutes or not as shown in a step S6 (Is standby operation time not shorter than 5 min.?). When the standby operation time exceeds 5 minutes, the operation is changed into the low-speed feed and cut operation as far as an abnormality or failure does not occur in the billet shear 14 as shown in steps S7 (Is billet shear stopped due to abnormality ?) and S8 (Carry out slow-speed feed and cut operation), in which the tip end section of the fore-most bar material B in the induction heating apparatus 1 is fed to the billet shear 14. During this low-speed feed and cut operation, the bar material B is fed at a speed lower than that during the normal operation while the bar material B is cut by the billet shear 14 thereby forming the billet materials b. Then, the billet materials b from the billet shear 14 are all fed to the billet material arranging apparatus 4 to be palletized. Thus, the billet materials b are fed to a location outside the normal forging line.

The inside of the induction heating apparatus 1 is divided into a plurality of heating zones in the direction of feed of the bar material B, in which the bar material B is heated higher as it nears the outlet of the induction heating apparatus 1. Accordingly, when the fore-most bar material B within the heating apparatus 1 is cut by the billet shear 14 under a slow-speed feed while the allowable limit time of the standby operation has been reached, the succeeding new bar material B is fed forward within the induction heating apparatus 1, and the standby operation for the new bar material B is repeated as shown in a step S9 (Has the foremost bar material within heating apparatus been completed ?). It will be understood that cutting of the billet material b under the slow-speed feed is made for the purpose of preventing the number of the billet materials b from unnecessarily increasing during the standby operation.

Figure 2:
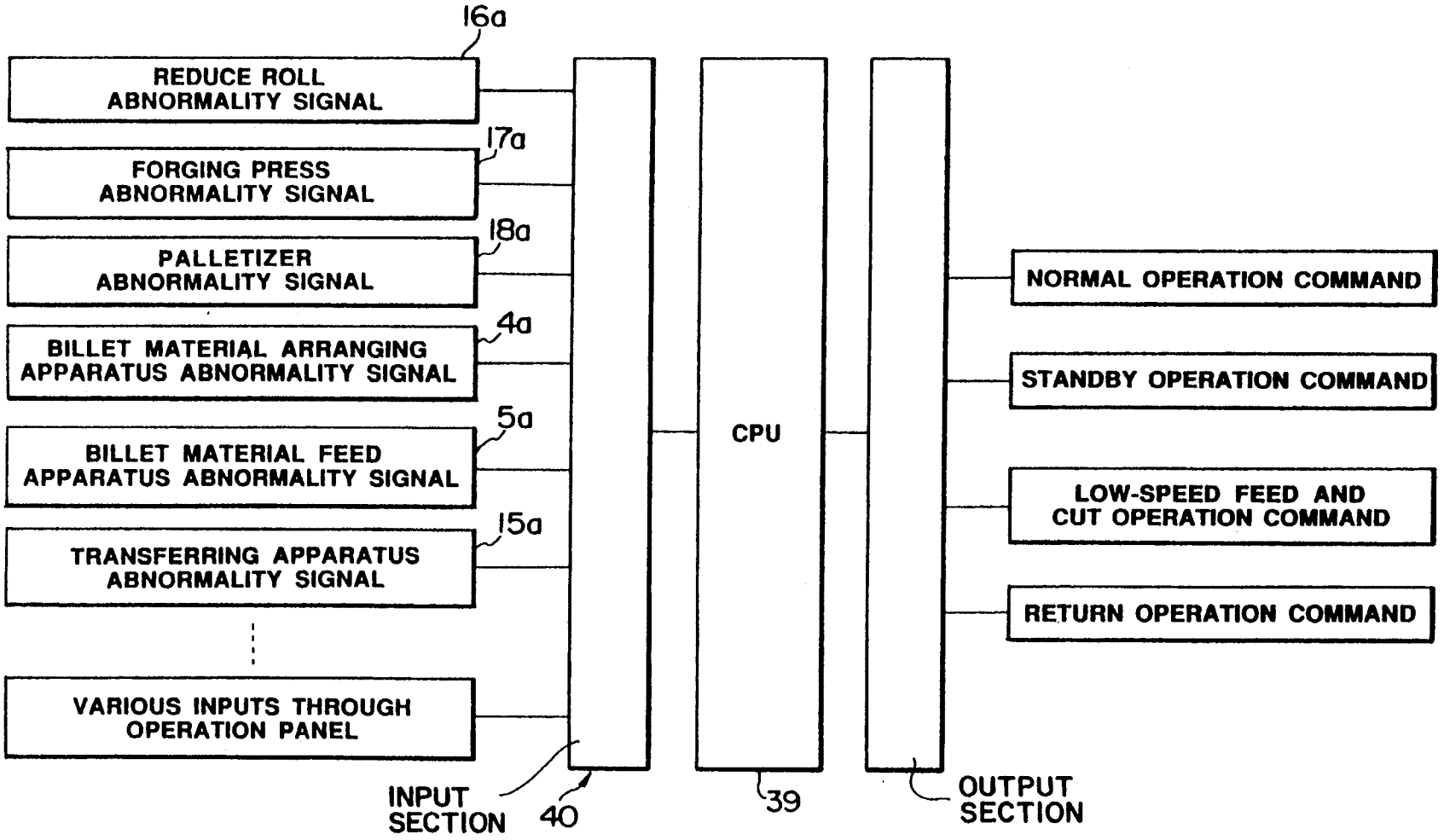
FIG. 2 is a block diagram of a controller in the forcing system of FIG. 1.

Additionally, if an operator turns ON a standby operation releasing switch (not shown) on an operation panel (not shown) attached to each of the various apparatuses upon the restoration of the abnormal condition, an input through the operation panel is made in the controller 40 as shown in FIG. 2 and therefore the operation is immediately changed to the normal operation even at any stages of operation of the forging system F as far as the billet shear 14 is not in a stopping state due to the abnormality as shown in steps S5 (Is standby operation released ?), S10 (Is standby operation released ?), S11 (Is billet shear stopped due to abnormality ?) and S12 (Start billet shear upon releasing standby operation). In other words, the purpose of the standby operation is to maintain a condition capable of reopening the normal operation whenever the abnormality occurs. In this connection, since the temperature of some (for example, two) billet materials b formed by the billet shear 14 immediately after reopening of normal operation are possibly too low and not within the above-mentioned suitable range, and therefore turning of the chute 21 toward the side of the reduce roll 16 is carried out after some billet materials b are fed to the side of the billet material arranging apparatus 4. Thereafter, the normal billet materials b are successively fed to the side of the reduce roll 16 as shown in steps S13 (feed first two billet materials to billet material arranging apparatus) and S14 (Carrying out normal operation).

Figure 3:
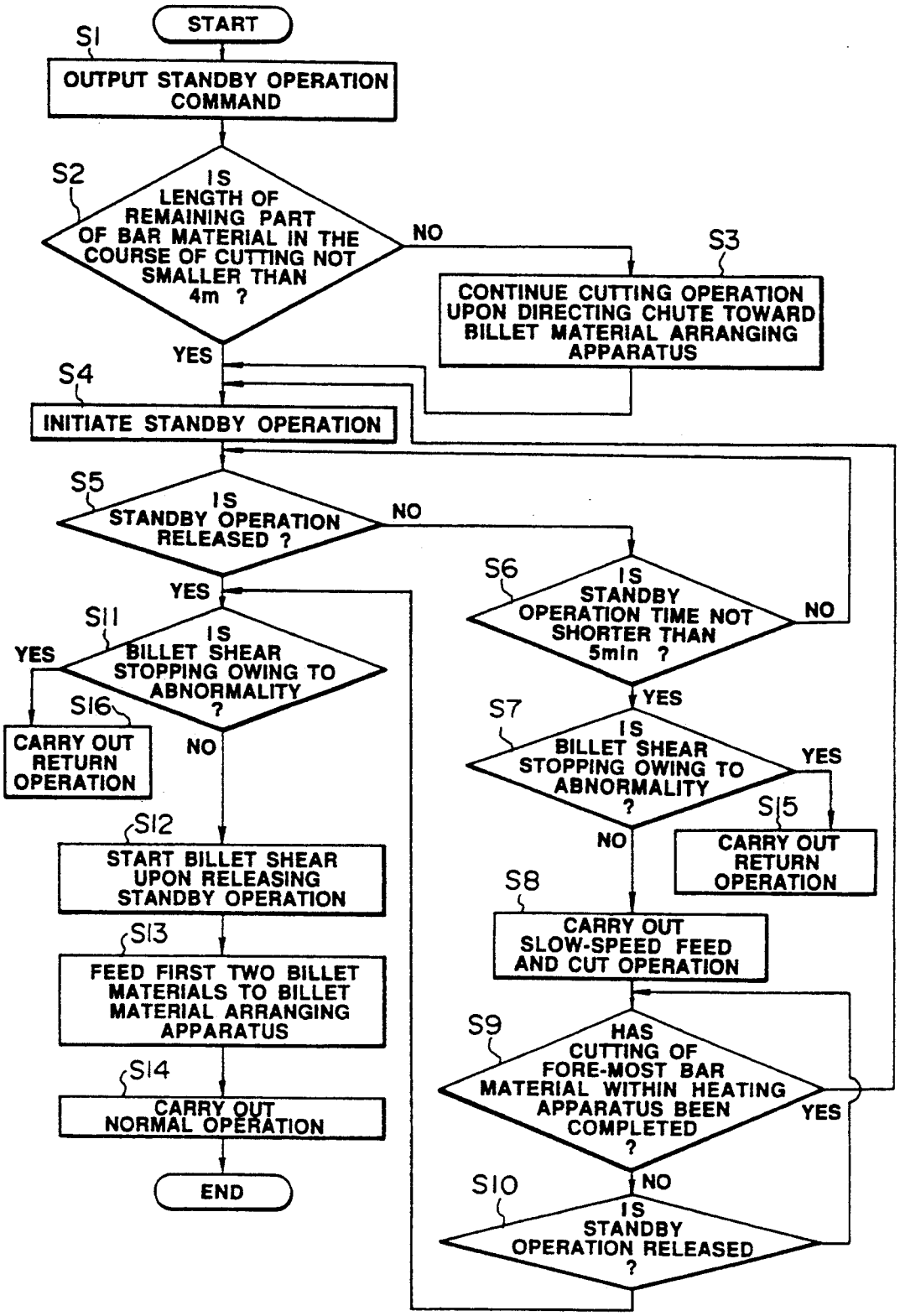
FIG. 3 is a flowchart showing a standby operation of the forging system of FIG. 1.

As shown in the steps S7 and S11 in FIG. 3, when the billet shear 14 is in a stopped state due to the abnormality or failure, the bar material B cannot be cut by the billet shear 14 to form the billet materials b and therefore the operation of the forging system F is changed into the return operation in steps S15 (Carrying out return operation) and S16 (Carrying out return operation). The return operation is accomplished when the operator turns ON a return operation switch (not shown) on the operation panel to make an input through the operation panel to the controller 40 under such an operator's judgement that a long time will be required for complete restoration or normalization of the abnormal condition (abnormality or failure) at occurrence of the abnormality on the downstream side in the normal forging line or during a restoring or normalizing operation for the abnormality, in addition to upon operational transferring from the standby operation as discussed above.

The return operation will be explained with reference to a flowchart of FIG. 4.

When the return operation command is output (or the return operation switch is turned ON by the operator) as shown in a step S17 (output return operation command (also by manual operation)), first a judgement is made as to whether the bar material B in the course of cutting is present within the induction heating apparatus 1 as shown in a step S18 (Is bar material in the course of cutting present?). In case of it being present, the cutting operation of the bar material B in the course of the cutting by the billet shear 14 is continued upon directing the chute 21 toward the side of the billet material arranging apparatus 14 as shown in steps S19 (Continue cutting upon directing chute toward billet material arranging apparatus). Then, a judgement is made as to whether the cutting operation of the bar material B in the course of cutting has been completed as shown in a step S20 (Has cutting of bar material in the course of cutting been completed). Then, the billet materials b formed by the billet shear 14 are supplied to the billet material arranging apparatus 4 to be palletized.

Otherwise, an electric current supply to the heaters of the induction heating apparatus 1 is interrupted in case no bar material B in the course of cutting is present within the induction heating apparatus 1, or when the cutting operation of the bar material has been completed even if the bar material B in the course of cutting is present within the induction heating apparatus 1, as shown in a step S21 (Interrupt current supply to heaters of heating apparatus).

Then a reverse operation of the bar material carrying apparatus 13 and the feed apparatus 7 is carried out thereby to return the bar material B within the induction heating apparatus 1 to the side of the returned material arranging apparatus 3 as the return area, as shown in steps S22 to S26. More specifically, the bar (returned) material B upon being heated is returned onto the feed apparatus 7 and gripped by the gripper 12 of the carrying head 11 of the returned material arranging apparatus 3 as shown in FIGS. 5 to 7. The thus gripped bar material B is carried onto an empty space on the bar material mount table 8. Then, the location, kind, time (at which the bar material B is carried in) and the like of the bar material B carried onto the bar material mount table 8 is memorized in the bar material control table of the controller 40 to be controlled.

Figure 4:
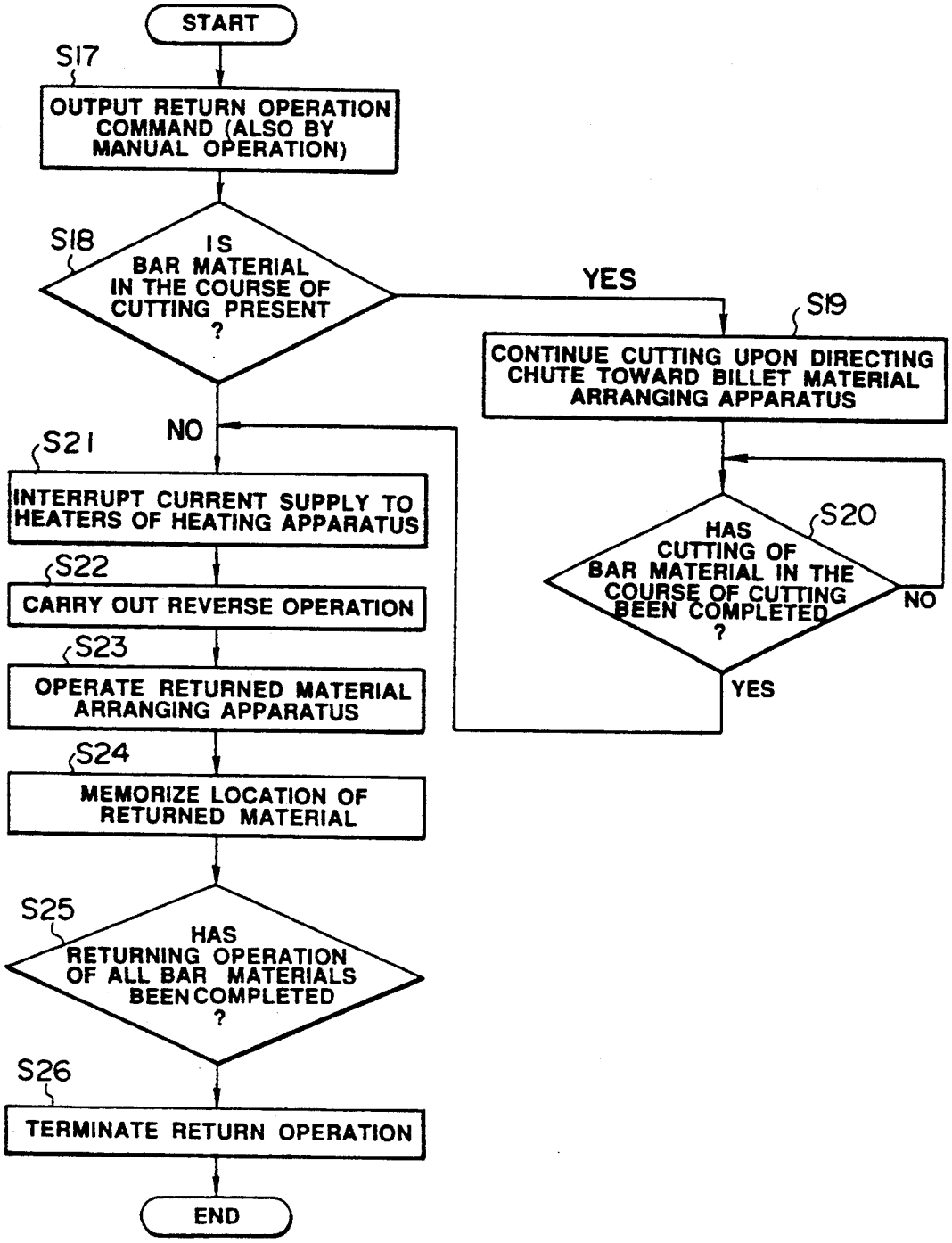
FIG. 4 is a flowchart showing a return operation of the forging system of FIG. 1.

This will be further explained along the flowchart of FIG. 4. Upon carrying out the reverse operation at the step S22 (Carry out reverse operation), the returned material arranging apparatus 3 is operated at the step S23 (Operate returned material arranging apparatus). Then, the locations of the returned materials B are memorized by the CPU 39 at the step S24. Consequently, a judgement is made as to whether the returning operation of all the bar materials B has been completed at the step S25 (Has returning operation of all bar materials been completed?). Finally, the return operation is terminated at the step S26 (Terminate return operation).

As appreciated from the above, according to this embodiment of the forging system, in case any trouble arises in a step or apparatus on the downstream side of the cutting step or billet shear 14 in the normal forging line, the standby operation is continued until the preset standby operation limit time has been filled. Additionally, the bar material B in the course of cutting by the billet shear 14 is cut when the preset standby operation limit time has been exceeded concurrently with again putting the succeeding bar materials B under the condition of the standby operation. This greatly reduces the number of the bar materials B which are to be returned as the returned materials and which have been once heated so as to be troublesome in handling. In this connection, according to the conventional forging system discussed before, the bar materials within the induction heating apparatus are immediately returned to the return area immediately upon arising of the abnormality.

Further, the billet materials b cut from the bar material B upon lapse of the standby operation limit time are palletized by the billet material arranging apparatus 4 without being fed to the downstream side step or apparatus. The thus formed billet materials b are easy to handle by using a forklift or the like. Additionally, the billet materials b are reusable after standing to be cooled.

Furthermore, in the above embodiment, the bar material B having the remaining part shorter than 4 m is cut even in case the standby operation command is made. Additionally, the bar material B in the course of cutting is cut as the billet materials b even in case the return operation command is made. Accordingly, the bar material B which is excessively short and in the course of cutting is prevented from being returned as the returned material to the side of the returned material arranging apparatus 3.

While the above embodiment has been shown and described such that the bar material B in the course of cutting is cut only in case the length of the bar material is less than 4 m upon detecting the length of the remaining part of the bar material B during the standby operation, it will be understood that the bar material B in the course of cutting may be cut regardless of the length of the remaining part.

I claim:

1. A forging method comprising the following steps:
heating an elongate bar material;
cutting said heated bar material into billet materials each having a predetermined length;
transferring said billet materials along a normal forging line;
forging said billet materials;
interrupting said cutting step and maintaining said bar material in the heating step without moving said bar material toward the cutting step when an abnormality arises in a step on a downstream side of the cutting step in the normal forging line; and
restarting said cutting step and transporting said billet materials formed after the restarting of said cutting step to a storing apparatus outside the normal forging line and storing said billet materials, unless said abnormality is normalized within a predetermined limit time;
wherein the normal forging line comprises a feed apparatus, an induction heating apparatus, a billet shear, a transferring apparatus, and a forging press.

2. A forging method as claimed in claim 1, wherein said abnormality arises in the forging step.

3. A forging method as claimed in claim 1, wherein the interrupting and maintaining step includes causing said bar material to make its reciprocating movement in a direction of feed of said bar material in the heating step.

4. A forging method as claimed in claim 1, wherein the storing step includes arranging said billet materials in a predetermined pattern.

5. A forging method as claimed in claim 1, further comprising, after the cutting step, the step of continuing said cutting to form said billet materials and delivering said billet materials to said storing apparatus if a remaining part of said bar material in the course of said cutting step is shorter than a predetermined length, even when said abnormality arises.

6. A forging method as claimed in claim 1, wherein the restarting and transporting step includes lowering an operational speed of the normal forging line as compared with that in a normal operation without said abnormality.

7. A forging system comprising:
means for heating an elongate bar material;
means for cutting said heated bar material into billet materials each having a predetermined length;
means for forging said billet materials which are successively transferred from said cutting means;
means for storing said billet materials fed from said cutting means, said storing means being outside of a normal forging line, said normal forging line comprising a feed apparatus, said heating means, said cutting means, a transferring apparatus, and said forging means;
means for interrupting a cutting operation of said cutting means and maintaining said bar material in said heating means without feeding said bar material to said cutting means, when an abnormality arises on a downstream side of said cutting means in the normal forging line; and
means for restarting the cutting operation of said cutting means and transporting said billet materials formed after the restarting of the cutting operation of said cutting means to said storing means, unless said abnormality is normalized within a predetermined limit time.

8. A forging system as claimed in claim 7, wherein said abnormality arises in said forging means.

9. A forging system as claimed in claim 7, wherein said interrupting and maintaining means includes means for causing said bar material to make its reciprocating movement in a direction of feed of said bar material in said heating means.

10. A forging system as claimed in claim 7, wherein said storing means includes means for arranging said billet materials in a predetermined pattern.

11. A forging system as claimed in claim 7, further comprising means for continuing the cutting operation of said cutting means to form said billet materials and delivering said billet materials to said storing means if a remaining part of said bar material in the course of said cutting is shorter than a predetermined length, even when said abnormality arises.

12. A forging system as claimed in claim 7, wherein said restarting and transporting means includes means for lowering an operational speed of the normal forging line as compared with that in a normal operation.

13. A forging system comprising:

means for heating an elongate bar material means for cutting said bar material into billet materials each having a predetermined length;

means for carrying said heated bar material to said cutting means, said carrying means being arranged to maintain said heated bar material within said heating means without feeding said heated bar material to said cutting means, in response to a standby operation command;

means for forging said billet materials fed from said cutting means;

means for storing said billet materials from said cutting means unless said billet materials from said cutting means are fed to said forging means;

means for detecting an abnormality on a downstream side of said cutting means in a normal forging line, said normal forging line comprising a feed apparatus, said means for heating said means for cutting, a transferring apparatus, and said means for forging, said detecting means being provided for said forging means;

control means for interrupting a cutting operation of said cutting means and providing said standby operation command to said carrying means in response to said abnormality detected by said detecting means, and for restarting the cutting operation of said cutting means and transporting said billet materials cut after the restarting of said cutting means to said storing means unless said abnormality is normalized within a predetermined limit time.

14. A forging system as claimed in claim 13, wherein said abnormality detecting means is adapted to detect the abnormality in said forging means.

15. A forging system as claimed in claim 13, wherein said carrying means is adapted to carry said bar material to said cutting means at a predetermined rate.

16. A forging system as claimed in claim 13, wherein said carrying means includes means for causing said bar material to make its reciprocating movement in a direction of feed of said bar material in said heating means.

17. A forging system as claimed in claim 13, wherein said storing means includes means for arranging said billet materials in a predetermined pattern.

18. A forging system as claimed in claim 13, further comprising means for continuing the cutting operation of said cutting means to form said billet materials and delivering said billet materials to said storing means if a remaining part of said bar material in the course of said cutting is shorter than a predetermined length, even when said abnormality arises.

19. A forging system as claimed in claim 13, wherein said restarting and transporting means includes means for lowering an operational speed of the normal forging line as compared with that in a normal operation.

20. A forging system as claimed in claim 13, further comprising means for guiding said billet materials from said cutting means toward said forging means in a first state and toward said storing means in a second state.

* * * * *